US008938814B2

(12) United States Patent
Tomono

(10) Patent No.: US 8,938,814 B2
(45) Date of Patent: Jan. 27, 2015

(54) GLOVE, AND METHOD FOR PRODUCING THE SAME

(71) Applicant: Katsuhito Tomono, Hyogo (JP)

(72) Inventor: Katsuhito Tomono, Hyogo (JP)

(73) Assignee: Showa Glove Co., Hyogo (JP)

( * ) Notice: Subject to any disclaimer, the term of this patent is extended or adjusted under 35 U.S.C. 154(b) by 0 days.

(21) Appl. No.: 13/672,776

(22) Filed: Nov. 9, 2012

(65) Prior Publication Data

US 2013/0305430 A1 Nov. 21, 2013

(30) Foreign Application Priority Data

Nov. 10, 2011 (JP) ..... 2011-246788

(51) Int. Cl.
*A41D 19/00* (2006.01)
*A41D 19/015* (2006.01)

(52) U.S. Cl.
CPC .... *A41D 19/01505* (2013.01); *A41D 19/01558* (2013.01); *A41D 19/0058* (2013.01); *A41D 2400/80* (2013.01)
USPC ..... 2/161.8; 2/161.6

(58) Field of Classification Search
USPC ..... 2/16, 159, 161.3, 161.8, 167, 168
See application file for complete search history.

(56) References Cited

U.S. PATENT DOCUMENTS

| | | | | |
|---|---|---|---|---|
| 1,885,572 | A * | 11/1932 | Wood | 601/137 |
| 3,883,899 | A * | 5/1975 | Ganz | 2/168 |
| 5,953,751 | A * | 9/1999 | Kobren | 2/16 |
| 6,055,669 | A * | 5/2000 | Albert | 2/161.1 |
| 6,081,928 | A * | 7/2000 | Bourne | 2/161.8 |
| 6,526,593 | B2 * | 3/2003 | Sajovic | 2/161.8 |
| 6,675,392 | B2 * | 1/2004 | Albert | 2/161.1 |
| 6,993,793 | B1 | 2/2006 | Li | |
| 7,018,692 | B2 * | 3/2006 | Kim et al. | 428/51 |
| 7,254,840 | B2 * | 8/2007 | Hammons et al. | 2/16 |
| 7,487,553 | B2 * | 2/2009 | Price | 2/161.1 |
| 2001/0044950 | A1 * | 11/2001 | Sajovic | 2/161.8 |
| 2006/0130212 | A1 * | 6/2006 | Kishihara | 2/161.6 |
| 2008/0083050 | A1 * | 4/2008 | Baker et al. | 2/161.8 |
| 2008/0235850 | A1 * | 10/2008 | Cabauy et al. | 2/161.8 |
| 2008/0244809 | A1 * | 10/2008 | Hassan et al. | 2/161.8 |
| 2009/0007313 | A1 * | 1/2009 | Boorsma et al. | 2/161.8 |
| 2009/0038051 | A1 * | 2/2009 | Fujihana et al. | 2/161.8 |
| 2009/0139010 | A1 * | 6/2009 | Bevier | 2/161.8 |
| 2009/0139011 | A1 * | 6/2009 | VanErmen et al. | 2/161.8 |
| 2010/0037364 | A1 * | 2/2010 | Saunders et al. | 2/161.7 |
| 2011/0088140 | A1 * | 4/2011 | Hassan et al. | 2/161.8 |
| 2011/0265246 | A1 | 11/2011 | Saito | |

FOREIGN PATENT DOCUMENTS

| | | |
|---|---|---|
| JP | 2000-328328 | 11/2000 |
| WO | WO-2012/070576 | 5/2012 |

* cited by examiner

*Primary Examiner* — Larry Worrell, Jr.
(74) *Attorney, Agent, or Firm* — Jordan and Hamburg LLP

(57) ABSTRACT

A glove comprising a glove body made from fibers; and a plurality of convexities fixed at least on the palm side area of the external surface of the glove body, the convexities comprising a base material made of a rubber or a resin, and a filler contained in the base material.

11 Claims, 3 Drawing Sheets

GLOVE, AND METHOD FOR PRODUCING THE SAME

BACKGROUND OF THE INVENTION

Field of Invention

The present invention relates to a glove, and a method for producing the same.

As a glove subjected to an anti-slipping processing, a coated glove has been known in which a coating layer including NBR latex and/or polyvinyl chloride paste, etc. is laminated on a glove made from fibers. In order to improve abrasion resistance of such a coated glove, the lamination is required to give a thick coating layer. However, providing a thick coating layer is disadvantageous in that the entirety of the glove becomes too hard, and thus it becomes difficult to flex fingers upon wearing, thereby resulting in a decreased working efficiency.

In order to overcome such a disadvantage, anti-slipping processed gloves in which a plurality of convexities are fixed in a scattered manner on an external surface of a glove body made from fibers have been developed (for example, Japanese Unexamined Patent Application, Publication No. 2000-328328). The convexities are generally formed by screen printing. Specifically, a plurality of convexities are fixed to a glove body by: placing on the glove body a masking plate on which a plurality of through holes are formed; filling the through holes of the masking plate with a sol-like convexity-forming material to allow the convexity-forming material to be attached onto the glove body; thereafter releasing the masking plate from the glove body; and heating the convexity-forming material adhered to the glove body to harden.

In order to improve abrasion resistance of such convexities, increasing a hardness of the convexities may be conceived. However, increasing the hardness of the convexities lowers elasticity of the convexities so that elastic deformation of the convexities by a frictional force with an object to be gripped becomes less likely to be caused. Therefore, a frictional force with the object to be gripped is likely to act on a bottom portion which is a site that the convexities are fixed to, and as a result, detachment of the convexities becomes likely to be caused.

In addition, in order to form the convexities having a high hardness described above, a viscosity of a material that forms convexities should be higher. However, it is difficult to surely fill the through holes of a masking plate with a convexity-forming material having a higher viscosity, thereby making the processing hard, eventually resulting in a possibly increased manufacturing cost.

Also, in order to increase a grip force of the anti-slipping processed glove to which convexities are fixed as described above, imparting elasticity to the convexities may be conceived. To that end, it is required to lower viscosity of a material that forms the convexities. However, when a viscosity of a convexity-forming material is low, the shape of the convexities is likely to change by its own weight in a heating step after the masking plate is released, whereby formation of the convexities into a desirable shape becomes difficult. When the convexities having an undesirable shape are present, a force is biased to a part of the convexities upon gripping a baggage, etc., and as a result, the part of convexities becomes likely to be worn and further the convexities may be detached from the glove.

PRIOR ART DOCUMENTS

Patent Documents

Patent Document 1: Japanese Unexamined Patent Application, Publication No. 2000-328328

SUMMARY OF THE INVENTION

The present invention was made in view of the foregoing disadvantages, and an object of the invention is to provide a glove being superior in abrasion resistance and flexibility and having a grip force less likely to be decreased even in use for a long period of time, and a method for producing thereof.

An aspect of the present invention made for solving the foregoing problems provides a glove including:

a glove body made from fibers, and a plurality of convexities fixed at least on the palm side area of the external surface of the glove body, the convexities comprising a base material made of a rubber or a resin, and a filler contained in the base material.

According to the glove, due to the convexities containing a filler, abrasion resistance of the convexities is improved, and a grip force is hardly decreased even in use for a long period of time. In addition, according to the glove, since the convexities contain a filler, the convexities have high shape retaining properties before hardening in a producing process, and thus convexities having a desirable shape can be accurately and surely formed. Furthermore, due to the convexities containing the filler, the base material has superior plate releasability. Accordingly, in forming the convexities by screen printing, the base material does not follow a plate when the plate is released after filling holes of the plate with the base material containing the filler, so that the convexities are less likely to be deformed and the convexities can be easily formed into a desirable shape.

In the glove, it is preferred that the glove body includes a main body portion formed for covering a main body of a hand and an extended portion leading out of the main body portion formed for covering fingers, and a convexity-free region in which the convexities are not formed is provided at sites corresponding to proximal interphalangeal joints on the surface of the palm side of the extended portion. Accordingly, flexibility is improved in the convexity-free region, so that fingers can be easily flexed. As a result, an excessive power is not required for a wearer in flexing his/her fingers, so that hand fatigue can be decreased and thus a working efficiency can be improved.

In the glove, it is preferred that the extended portion includes an index finger portion, a middle finger portion and a ring finger portion that cover an index finger, a middle finger and a ring finger, respectively, and a convexity-free region in which the convexities are not formed is provided at sites corresponding to proximal interphalangeal joints on the surface of the palm side of the extended portion. Due to the glove body being formed such that the glove body covers a worker's five fingers, respectively, in such a manner, the movable range of fingers of the worker can be broadened. In addition, due to the convexity-free region provided at sites corresponding to proximal interphalangeal joints of the index finger portion, the middle finger portion and the ring finger portion on the palm side, fingers can be easily flexed, and it becomes easy for a worker to grip a baggage, etc.

In the glove, it is preferred that the convexities include a substantially flat top surface. Due to the substantially flat top surface being brought into contact with an object to be gripped, a contact area of the convexities with the object to be gripped is increased, and thus abrasion resistance and a grip force of the glove are improved.

In the glove, it is preferred that a principal component of the base material is a polyvinyl chloride-based resin. Due to the polyvinyl chloride-based resin that is superior in processability and economic efficiency, manufacturing costs can be lowered.

In the glove, it is preferred that the mean particle size of the filler is no greater than 300 μm. Due to the filler having the mean particle size being no greater than the upper limit value, elimination of the filler can be prevented. In addition, plate releasability of the base material is improved, whereby the convexities having a substantially uniform shape can be formed.

It is preferred that the content of the filler is no less than 4 parts by mass and no greater than 400 parts by mass with respect to 100 parts by mass of the base material. Accordingly, the convexities can have sufficient abrasion resistance. In addition, the plate releasability of the base material is improved also by the filler having the content in the range so that convexities having a substantially uniform shape can be formed.

It is preferred that at least the surface of the filler is made from an organic substance. Accordingly, the adhesiveness of a base material made of a rubber or a resin to the filler is enhanced, whereby improper elimination of the filler can be prevented. As a result, the convexities have sufficient abrasion resistance, whereby a glove is obtained in which a grip force is less likely to be decreased even in use for a long period of time.

It is preferred that the glove further comprises a coating layer that coats an external surface of the convexities and the glove body in a region provided with the plurality of convexities. Due to the convexities being coated by the coating layer in such a manner, abrasion and detachment of the convexities can be more effectively prevented.

It is preferred that the coating layer contains anti-slipping particles. Of the anti-slipping particles contained in the coating layer, an anti-slipping particle protruding from the surface of the coating layer achieves an anti-slipping effect, whereby the grip force of the glove can be further enhanced.

It is preferred that the coating layer has a plurality of fine voids in the glove. Accordingly, flexibility of the glove can be improved.

Another aspect of the present invention made for solving the problems provides a method for producing a glove, the method including:

a convexity-forming material preparation step for preparing a convexity-forming material including a base material made of a rubber or a resin, and a filler;

an attaching step for attaching the convexity-forming material on an external surface of a glove body by placing a plate having a plurality of through holes on the external surface of the palm side area of the glove body, followed by filling the through holes of the plate with the convexity-forming material to permit attaching;

a plate release step for releasing the plate after the attaching step; and a convexity hardening step of heating the convexity-forming material to harden the convexities after releasing the plate.

According to the method for producing a glove, a glove having a plurality of convexities on the external surface of the palm side area of the glove body can be produced. Also, the glove obtained by the method for producing the glove is superior in abrasion resistance, and anti-slipping properties, as described above.

The term "palm side area" as referred to in the glove and the method for producing the same means a surface which faces to an object upon gripping the object and covers a face of the entirety from the wrist to fingertips including fingers. In addition, "main body of hand" is referred to as a portion excluding fingers of a hand and as a site that includes from bottoms and crotches of fingers to a wrist.

As described above, the present invention can provide a glove being superior in abrasion resistance and flexibility and having a grip force less likely to be decreased even in use for a long period of time, and a method for producing the same.

Hereinafter, the embodiments of the invention will be described in detail with appropriate references to the drawings.

FIRST EMBODIMENT

Figure 1:
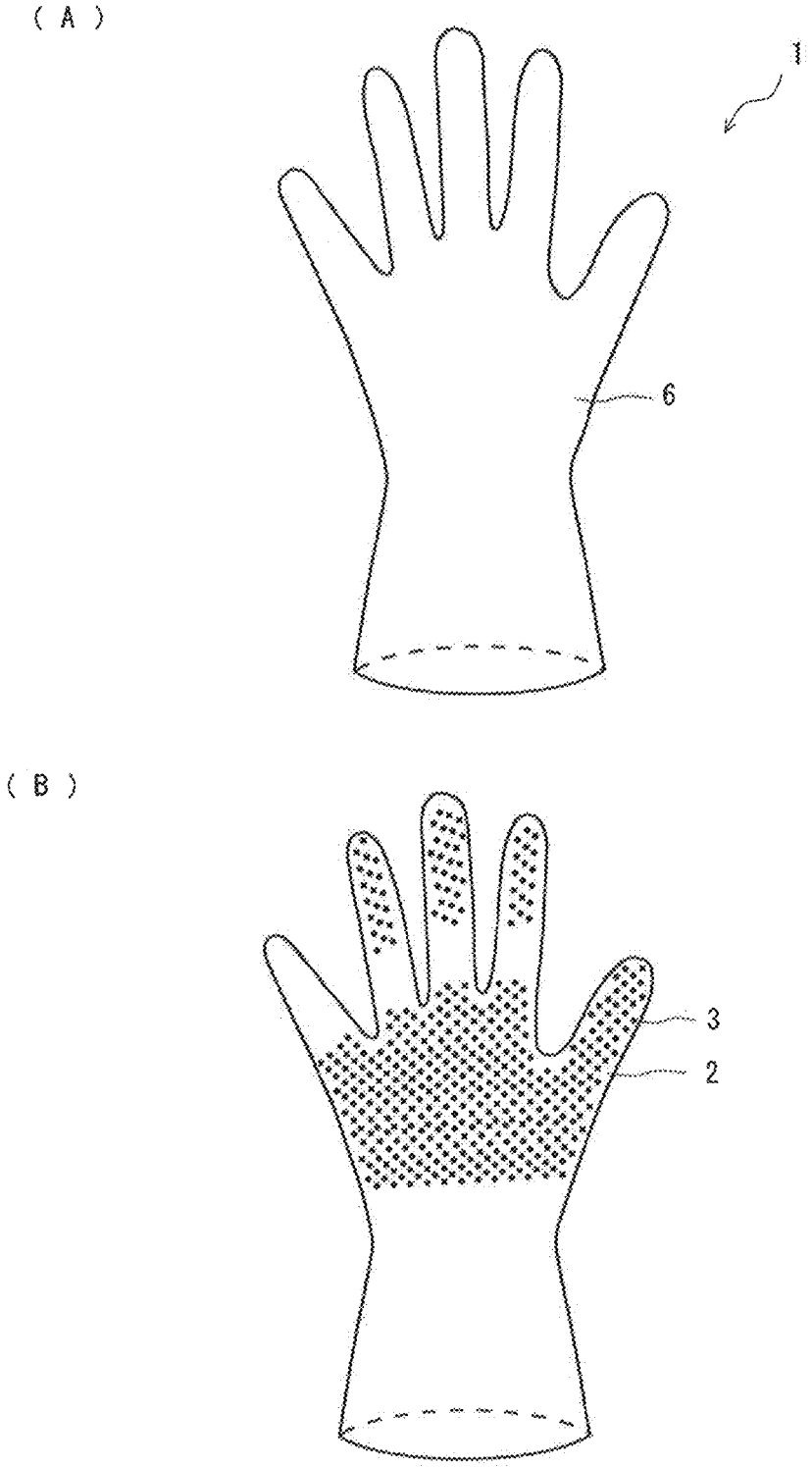
FIG. 1A shows a schematic front view illustrating a glove according to a first embodiment of the present invention viewed from the palm side.
FIG. 1B shows a schematic front view illustrating the glove shown in FIG. 1A from the palm side, in a state before a coating layer is coated.

A glove 1, as shown in FIG. 1B, includes a glove body 2 made from fibers, a plurality of convexities 3 fixed to at least the palm side area of the external surface of the glove body 2, and as shown in FIG. 1A, further includes a coating layer 6 that coats an external surface of the convexities 3 and the glove body 2.

<Glove Body>

The glove body 2 is organized in a glove shape by fibers including a cotton thread, etc. The glove body 2 includes a main body portion formed for covering a main body of a hand of a wearer, an extended portion extended from the main body portion formed for covering fingers of the wearer, and a cylindrical proximal portion for covering a wrist of the wearer, the cylindrical proximal portion being extended from the main body portion toward an opposite direction to the extended portion. The extended portion has a thumb portion, an index finger portion, a middle finger portion, a ring finger portion and a little finger portion that cover a thumb, an index finger, a middle finger, a ring finger and a little finger, respectively, of the wearer. These portions are formed in a cylindrical shape having fingertip portions closed. In addition, the proximal portion has an opening into which the wearer can insert his/her hand and is formed in a cylindrical shape to provide the opening having the diameter gradually increases toward the opened edge.

The glove body 2 has voids between fibers threads, and thus a base material 5 constituting the convexities 3 and/or a material of the coating layer 6 can enter into the voids, whereby the convexities 3 and the coating layer 6 described later are impregnated, thereby resulting in a firm fixing of the convexities 3 or the coating layer 6 to the glove body 2.

Fibers that configure the glove body 2 are not particularly limited, and examples of the fibers include nylon fibers, polyester fibers, cotton, hemp, rayon fibers, acryl fibers, aramid fibers, high-intensity polyethylene fibers, polyurethane fibers, polypara-phenyleneterephthalamide fibers (trade name: "Kevlar (registered trademark)", manufactured by Du Pont Kabushiki Kaisha, etc.), high-density polyethylene fibers (trade name: "Dyneema (registered trademark)", manufactured by TOYOBO CO. LTD, etc.), fibers in which a stainless wire is covered with nylon, and the like. These fibers may be used alone, or as a mixture of two or more types thereof. Although the glove body 2 is formed by organizing the fibers, a glove formed of a woven or nonwoven fabric provided using the fibers by cutting out to give a glove shape followed by sewing may be used. Of these, a glove organized using a seamless knitting machine is preferred due to the absence of seams.

The upper limit value of the average thickness of the glove body 2 is preferably 1 mm and more preferably 0.5 mm. On the other hand, the lower limit value of the average thickness of the glove body 2 is preferably 0.1 mm and more preferably 0.2 mm. When the average thickness of the glove body 2 exceeds the upper limit value, flexibility is deteriorated with an increase in thickness of the glove 1, whereby workability upon wearing may be impaired. To the contrary, when the average thickness of the glove body 2 is less than the lower limit value, strength of the glove itself becomes insufficient, whereby durability may be deteriorated. The average thickness of the glove body 2 is a mean value obtained by a determination using "DIAL THICKNESS GAUGE DS-1211 (trade name, manufactured by Niigata seiki Co., Ltd.)" by measuring at arbitrary five points in a region in which the convexities 3 are not formed.

The glove body 2 may be subjected to various types of treatments using, for example, a softening agent, a water-repellent and an oil-repellent agent, antimicrobials, and the like. In addition, an ultraviolet ray preventing function may be imparted by application, impregnation or the like of an ultraviolet ray absorbing agent, etc.

<Convexities>

The plurality of convexities 3 are arranged in a scattered manner in at least the palm side area of the external surface of the glove body 2. The plurality of convexities 3 are formed to have a substantially similar size, and are evenly arranged with substantially equal intervals.

The plurality of convexities 3, as shown in FIG. 1B, are arranged on substantially the entire surface of the main body portion and a part of the extended portion within at least the palm side area of the glove body 2, and the convexity-free region in which the convexities 3 are not formed is provided at sites corresponding to the proximal interphalangeal joints of the extended portions.

Specifically, in the index finger portion, the middle finger portion and the ring finger portion of the palm side area, the plurality of convexities 3 are arranged in a specified region starting from the fingertip (hereinafter, the region may be also referred to as "fingertip convexity-containing region"). In addition, in the index finger portion, the middle finger portion and the ring finger portion of the palm side area, regions closer to the base of finger (i.e., a portion connected to the main body portion) than the fingertip convexity-containing region are defined as the convexity-free region in which the convexities 3 are not formed. In other words, in the index finger portion, the middle finger portion and the ring finger portion of the palm side area, convexity-free regions are provided in regions including sites corresponding to the proximal interphalangeal joints.

Here, the fingertip convexity-containing region is preferably defined as a region from the fingertip to a position apart by no less than 20% and no greater than 50% of the length of each finger portion (i.e., the greatest distance from the base to the fingertip), and is more preferably defined as a region from the fingertip to a position apart by no less than 25% and no greater than 40% of the length of each finger portion. When the fingertip convexity-containing region exists to exceed the upper limit value, the convexities 3 shall be present at a site corresponding to the proximal interphalangeal joint of a wearer, whereby it may be difficult to flex the finger. To the contrary, when the fingertip convexity-containing region exists to be insufficient for the lower limit value, the convexities 3 are not precisely positioned at sites corresponding to the finger pads of the wearer (i.e., sites closer to fingertip than distal interphalangeal joint), whereby abrasion resistance and a grip force may be lowered.

In addition, the convexity-free region is preferably defined as a region covering from a position apart by a-third of the length of each finger portion from the base of each finger portion, to positions apart by no less than 5% and no greater than 16% of the length of each finger portion along both directions toward the bottom and the fingertip of the finger portions, respectively, and is more preferably defined as a region covering from a position apart by a-third of the length of each finger portion from the bottom of each finger portion, to positions apart by no less than 10% and no greater than 15%. When the region exists to exceed the upper limit value, the convexities 3 are not precisely positioned at sites corresponding to the finger pads of a wearer, whereby the abrasion resistance and the grip force may be lowered. In addition, when the region exists to be insufficient for the lower limit value, the convexities 3 shall be present at a site corresponding to the proximal interphalangeal joint of a wearer, whereby it may be difficult to flex the finger.

Furthermore, the convexities 3 are formed over the entire surface of the palm side area of the thumb portion, and the convexity-free region is not provided in the thumb portion. Moreover, the convexities 3 are not arranged in the palm side area of the little finger portion.

In addition, in the convexity-containing region in which the convexities 3 are formed (i.e., the fingertip convexity-containing region, the thumb portion and the main body portion), the upper limit value of the proportion of the area (i.e., area percentage) of the convexities 3 per unit area of the glove body 2 is preferably 80% and more preferably 60%. On the other hand, the lower limit value of the area percentage is preferably 3% and more preferably 5%. In particular, in the fingertip convexity-containing region and the thumb portion to which the force is likely to concentrate, the upper limit value of the area percentage of the convexities 3 per unit area of the glove body 2 is preferably 85% and more preferably 65%. On the other hand, the lower limit value of the area percentage is preferably 20% and more preferably 30%. When the area percentage exceeds the upper limit value, flexibility of the glove 1 may be deteriorated. To the contrary, when the area percentage is less than the lower limit value, the abrasion resistance and/or the grip force may be lowered and/or an anti-slipping effect may not be sufficiently obtained.

The convexities 3 are fixed to the glove body 2 in a standing pole shape. The convexities 3 are formed into a substantially columnar shape having a substantially circular and substantially flat top surface.

The upper limit value of the mean area of the top surfaces (i.e., the mean area of the substantially flat surfaces projected on a surface parallel to the surface of the glove body 2) is preferably 28 mm, more preferably 20 $mm^2$ and further preferably 13 $mm^2$. On the other hand, the lower limit value of the mean area of the top surfaces is preferably 2 $mm^2$ and more preferably 3 $mm^2$. Specifically, the upper limit value of the mean diameter of the substantially circular top surfaces is preferably 6 mm, more preferably 5 mm and further preferably 4 mm. On the other hand, the lower limit value of mean diameter of the top surfaces of the convexities 3 is preferably 1 mm and more preferably 2 mm. When the mean area or the mean diameter of the top surfaces exceeds the upper limit value, flexing of a glove is prevented due to an increased area of the top surfaces, whereby flexibility of the glove may be deteriorated. To the contrary, when the mean area or the mean diameter of the top surfaces is less than the lower limit value, the area of the top surfaces is too small, whereby the abrasion resistance and the grip force may not be sufficiently obtained.

In addition, the upper limit value of the average protrusion height of the convexities 3 (i.e., the mean distance from the surface of the glove body 2 to tips (i.e., top surfaces) of the convexities 3) is preferably 3 mm, more preferably 2 mm, and further preferably 1 mm. On the other hand, the lower limit value of the average protrusion height of the convexities 3 is preferably 0.1 mm, more preferably 0.3 mm and further preferably 0.5 mm. When the average protrusion height of the convexities 3 exceeds the upper limit value, the convexities 3 may be likely to be detached. To the contrary, when the average protrusion height of the convexities 3 is less than the lower limit value, the abrasion resistance and the grip force resulting from the convexities 3 may not be sufficiently obtained.

Figure 2:
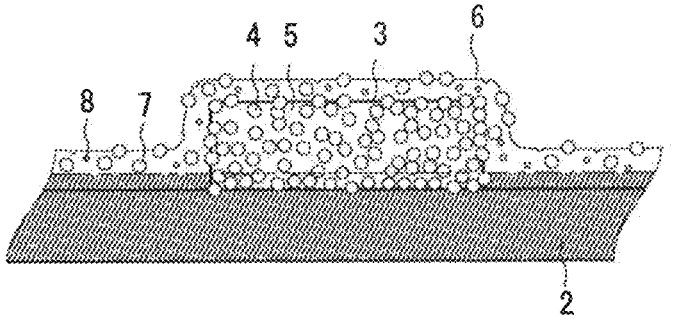
FIG. 2 shows a schematic partial cross sectional view illustrating convexities of the glove shown in FIG. 1.

As shown in FIG. 2, bases of the convexities 3 are impregnated in the surface layer of the glove body 2. Accordingly, the convexities 3 are firmly fixed to the glove body 2, whereby the convexities 3 can be precisely prevented from detaching from the glove body 2 in use. Though only the convexities 3 are schematically illustrated and the glove body 2 is not illustrated at the bottom portion of the convexities 3 shown in FIG. 2, not only the convexities 3 but also fibers of the glove body 2 are present at the bottom portion. In other words, the bottom portion of the convexities 3 has been infiltrated into voids of fibers of the glove body 2. In addition, the bottom portion of the convexities 3 is impregnated through the surface layer of the glove body 2 preferably by no less than 50 μm, and more preferably by no less than 100 μm. When the extent of impregnation is less than the lower limit value, the fixing strength of the convexities 3 to the glove body 2 becomes so low that the convexities 3 may be detached from the glove body 2 during the working. The upper limit value of the extent of the impregnation is identical to the thickness of the glove body 2.

Furthermore, the convexities 3 have elasticity. The upper limit value of the surface hardness of the convexities 3 is preferably A99, more preferably A98 and further preferably A97 in terms of a measured value using type A of a durometer hardness scale. On the other hand, the lower limit value of the surface hardness of the convexities 3 is preferably A50, more preferably A65 and further preferably A75 in terms of a measured value using type A of a durometer hardness scale. When the surface hardness of the convexities 3 exceeds the upper limit value, the elasticity of the convexities 3 is deteriorated, whereby elastic deformation of the convexities 3 due to a frictional force between the convexities 3 and an object to be gripped is less likely to occur, and the frictional force between the convexities 3 and the object to be gripped is likely to act on a site where the convexities 3 are fixed to the glove body 2 (i.e., bottom portion of convexities 3), making the convexities 3 likely to be detached from the glove body 2. To the contrary, when the surface hardness of the convexities 3 is less than the lower limit value, sufficient abrasion resistance by the convexities 3 may not be obtained. The surface hardness is represented as a value measured in accordance with a method specified in JIS K6253.

The convexities 3 are constituted with the base material 5 made of a rubber or a resin, and a filler 4 contained in the base material 5.

The base material 5 includes a rubber or a resin that serves as a principal component. Examples of the rubber include a styrene-butadiene rubber, a nitrile-butadiene rubber, a urethane rubber, an isoprene rubber, an acryl rubber, a chloroprene rubber, a butyl rubber, a butadiene rubber, a fluorine rubber, an epichlorohydrin rubber, an ethylene-propylene rubber, natural rubbers, and the like. In addition, examples of the resin include a polyvinyl chloride-based resin, an acrylic resin, a polyethylene-based resin, a polypropylene-based resin, a polystyrene-based resin, a silicone-based resin, a polyurethane-based resin, a polyvinyl alcohol-based resin, a vinylidene chloride-based resin, a chlorinated polyethylene-based resin, an ethylene-vinyl alcohol copolymer resin, and the like. Of these, a rubber or a resin enabling the durometer hardness after hardening to be adjusted to no less than A50 is preferred, and a polyvinyl chloride-based resin is more preferred in light of being superior in processability and economic efficiency. These may be used alone, or in combination of two or more types thereof.

In addition, the base material 5 may further contain other additive in addition to the principal component described above. The other additive is exemplified by a plasticizer, a stabilizer, a thickening agent, and the like.

Examples of the plasticizer include phthalic acid esters such as dimethyl phthalate, diethyl phthalate, dibutyl phthalate, diisobutyl phthalate, dioctyl phthalate, butyloctyl phthalate, di-(2-ethylhexyl)phthalate, diisononyl phthalate, diisooctyl phthalate and diisodecyl phthalate; fatty acid esters such as dimethyl adipate, diisobutyl adipate, di-(2-ethylhexyl)adipate, diisononyl adipate, diisooctyl adipate, diisodecyl adipate, octyldecyl adipate, di-(2-ethylhexyl)azelate, diisooctyl azelate, diisobutyl azelate, dibutyl sebacate, di-(2-ethylhexyl)sebacate and diisooctyl sebacate; trimellitic acid esters such as trimellitic acid isodecyl ester, trimellitic acid octyl ester, trimellitic acid n-octyl ester and trimellitic acid-based isononyl ester, as well as alkylsulfonic acid phenyl esters, di-(2-ethylhexyl)fumarate, diethylene glycol monooleate, glyceryl monoricinoleate, trilauryl phosphate, tristearyl phosphate, tri-(2-ethylhexyl)phosphate, tricresyl phosphate, epoxydated soybean oil or polyether ester, and the like. These may be used alone, or in combination of two or more types thereof. The amount of the plasticizer blended is preferably no less than 50 parts by mass and no greater than 200 parts by mass with respect to 100 parts by mass of the solid content of the rubber or resin. When the amount of the plasticizer blended is less than 50 parts by mass, sufficient plasticity may not be obtained. To the contrary, when the amount of the plasticizer blended exceeds 200 parts by mass, a bleeding may occur.

The stabilizer is exemplified by a Ba—Zn-based stabilizer, an Mg—Zn-based stabilizer, a Ca—Zn-based stabilizer, and the like. The amount of the stabilizer blended is preferably no less than 1 part by mass and no greater than 10 parts by mass with respect to 100 parts by mass of the solid content of the rubber or resin. When the amount of the stabilizer blended is less than 1 part by mass, sufficient stability may not be obtained. To the contrary, when the amount of the stabilizer blended exceeds 10 parts by mass, the bleeding may be caused by the stabilizer.

The thickening agent is exemplified by silica fine powder, calcium carbonate fine powder, and the like.

The material of the filler 4 is not particularly limited, and is exemplified by organic substances such as a resin, a rubber and a natural materials, or inorganic substances. More specifically, examples of the resin include polyvinyl chloride-based resins (copolymers (including graft polymers) such as an acryl copolymer, an ethylene-vinyl acetate copolymer and an ethylene copolymer, and the like), polystyrene-based resins, acrylic resins (a polymethyl methacrylate (PMMA) resin, etc.), polycarbonate (PC)-based resins, phenol-based resins, urea-based resins and melamine-based resins, whereas examples of the rubber include synthetic rubbers, natural rubbers and the like, and examples of the natural material include a walnut, rice hulls, and the like. Also, examples of the inorganic substance include silica, alumina, zinc oxide, potassium titanate, calcium carbonate, calcium silicate, and the like. Of these, organic substances are preferred in light of being superior in adhesiveness to the base material 5, a resin and a rubber are more preferred, and a polyvinyl chloride-based resin is further preferred. These materials may be used alone, or as a mixture of two or more types thereof. In addition, the filler 4 may have the surface configured with the material described above, and the inner part which may be either hollow or configured with a material different from that of the surface. Also in such cases, the material of the surface is preferably an organic substance in light of being superior in adhesiveness with the base material 5, more preferably a resin and a rubber, and further preferably a polyvinyl chloride-based resin.

The shape of the filler 4 is exemplified by a spherical shape, a semi-spherical shape, a cubic shape, a needle shape, a rod shape, a spindle shape, a plate shape, a scale shape, a fiber shape, a polyhedron shape, and the like. Of these, a spherical shape is preferred since the filler 4 having a spherical shape is less likely to scratch the surface of an object to be gripped.

In addition, the upper limit value of the mean particle size of the filler 4 is preferably 300 μm, more preferably 250 μm and further preferably 220 μm. When the mean particle size of the filler 4 exceeds the upper limit value, the filler 4 may be easily eliminated. Further, when the mean particle size of the filler 4 exceeds the upper limit value, it may be difficult to form the convexities 3 having a uniform shape. Particularly, in the case in which the convexities 3 are formed using a masking plate having through holes, formation of the convexities 3 having a desired shape may be difficult. Specifically, it may be difficult to form the convexities 3 having a desired shape in the case where the convexities 3 are formed by: supplying a convexity-forming material on the surface of a masking plate placed on the external surface of the glove body 2, sliding a squeegee over the surface of the plate to fill the through holes of the masking plate with the convexity-forming material, and subsequently releasing the masking plate, followed by hardening the convexity-forming material. The difficulty in formation of the convexities 3 having a desired shape is believed to result from the gap likely to be generated between the squeegee and the surface of the plate during sliding the squeegee due to the filler 4, whereby the convexity-forming material remains on the surface of the plate owing to the gap, and thus when the masking plate is released, the convexity-forming material that remains on the surface of the plate follows the convexity-forming material filled in the through holes, leading to deformation of the convexity-forming material that was filled in the through holes. On the other hand, the lower limit value of the mean particle size of the filler 4 is preferably 0.1 μm, more preferably 0.5 μm and further preferably 1 μm. When the mean particle size of the filler 4 is less than the lower limit value, handling in production may be difficult. The mean particle size is a value determined through classification using a sieve in accordance with JIS Z 8801.

The upper limit value of the amount of the filler 4 added is preferably 400 parts by mass, more preferably 240 parts by mass and further preferably 150 party by mass with respect to 100 parts by mass of a base material. On the other hand, the lower limit value of the filler 4 added is preferably 4 parts by mass, more preferably 10 parts by mass and further preferably 20 parts by mass with respect to 100 parts by mass of the base material. When the amount of the filler 4 added exceeds the upper limit value, the amount of the filler 4 with respect to the base material 5 becomes excessive, and thus the convexities 3 may be likely to be detached from the glove body 2. To the contrary, when the amount of the filler 4 added is less than the lower limit value, the amount of the filler 4 with respect to the base material 5 becomes so small that sufficient abrasion resistance may not be obtained. In addition, when the amount of the filler 4 added is less than the lower limit value, releasability of the convexity-forming material is deteriorated. Therefore, the base material 5 follows the plate when the masking plate is released, whereby it may be difficult to form the convexities 3 having a uniform shape. Also, shape retention of the convexities 3 as before hardening is deteriorated, thereby leading to deformation of the shape by its own weight, and thus it may be difficult to form the convexities 3 having a uniform shape.

<Coating Layer>

The coating layer 6 is laminated on the external surface of the glove body 2 and the convexities 3 such that the coating layer 6 coats the entire surface of the glove 1. The principal component of the coating layer 6 is a rubber or a resin.

As a rubber or a resin that serves as the principal component of the coating layer 6, the rubber or the resin used as the base material 5 of the convexities 3 may be used. Of these, a polyvinyl chloride-based resin is preferred in light of being superior in processability and economic efficiency. Here, it is preferred that the principal component of the coating layer 6 is identical to the principal component of the base material 5 of the convexities 3. When the principal component of the coating layer 6 identical to the principal component of the base material 5 is used, adhesiveness between the coating layer 6 and the convexities 3 can be improved.

The upper limit value of the average thickness of the coating layer 6 is preferably 1.8 mm and more preferably 1.5 mm. On the other hand, the lower limit value of the average thickness of the coating layer 6 is preferably 0.05 mm and more preferably 0.1 mm. When the average thickness of the coating layer 6 exceeds the upper limit value, flexibility of the glove may be deteriorated. To the contrary, when the average thickness of the coating layer 6 is less than the lower limit value, formation of the coating layer 6 becomes difficult and the strength of the coating layer 6 may be decreased. The average thickness of the coating layer 6 as referred to as means a thickness of a portion that does not involve the convexities 3 in the central portion of the palm area of the glove 1, and is represented as a mean value obtained by measuring the thicknesses at arbitrary five points of the coating layer 6 excluding a portion impregnated into the glove body 2 (i.e., a distance from the external surface of the coating layer 6 to the surface of the glove body 2).

The coating layer 6 contains an anti-slipping particle 7. The material of the anti-slipping particle 7 is not particularly limited, and examples of the material of the anti-slipping particle 7 include resins such as polyvinyl chloride-based resins (copolymers (including graft polymers) such as an acryl copolymer, an ethylene-vinyl acetate copolymer and an ethylene copolymer, and the like), polystyrene-based resins, acrylic resins (a polymethyl methacrylate (PMMA) resin, etc.), polycarbonate (PC)-based resins, phenol-based resins, urea-based resins and melamine-based resins; rubbers such as synthetic rubbers and natural rubbers; inorganic substances such as silica, alumina, zinc oxide, potassium titanate, calcium carbonate and calcium silicate; natural materials such as walnut and rice hulls. Of these, resins and rubbers superior in adhesiveness to the coating layer 6 are preferred, and a polyvinyl chloride-based resin is more preferred. These materials may be used alone, or as a mixture of two or more types thereof. In addition, the anti-slipping particle 7 may have the surface configured with the material described above, and the inner part which may be either hollow or configured with a material different from that of the surface. Also in such cases, the material of the surface is preferably a resin or a rubber superior in adhesiveness to the coating layer 6, and a polyvinyl chloride-based resin is more preferred. Here, it is preferred that the principal component used in the coating layer 6 is identical to the principal component of the surface of the anti-slipping particle 7. Due to using the principal component of the anti-slipping particle 7 identical to the principal component of the surface of the coating layer 6, adhesiveness of the anti-slipping particle 7 to the coating layer 6 can be improved.

The shape of the anti-slipping particle 7 is exemplified by a spherical shape, a semi-spherical shape, a cubic shape, a needle shape, a rod shape, a spindle shape, a plate shape, a scale shape, a fiber shape, and the like. Of these, a spherical shape is preferred since the anti-slipping particle 7 having a spherical shape is less likely to scratch the surface of an object to be gripped.

The upper limit value of the mean particle size of the anti-slipping particles 7 is preferably 200 μm and more preferably 180 μm. On the other hand, the lower limit value of the mean particle size of the anti-slipping particles 7 is preferably 100 μm and more preferably 120 μm. When the mean particle size of the anti-slipping particles 7 exceeds the upper limit value, the anti-slipping particle 7 may be easily eliminated from the coating layer 6. To the contrary, when the mean particle size of the anti-slipping particle 7 is less than the lower limit value, handling in production may be difficult. The mean particle size is represented as a value determined through classification using a sieve.

The upper limit value of the amount of the anti-slipping particle 7 added is preferably 400 parts by mass, more preferably 240 parts by mass and further preferably 130 parts by mass with respect to 100 parts by mass of the principal component of the coating layer 6. On the other hand, the lower limit value of the amount of the anti-slipping particle 7 added is preferably 4 parts by mass, more preferably 10 parts by mass and further preferably 20 parts by mass with respect to 100 parts by mass of the principal component of the coating layer 6. When the amount of the anti-slipping particle 7 added exceeds the upper limit value, the amount of the anti-slipping particle 7 with respect to the coating layer 6 becomes excessive, and thus the anti-slipping particle 7 may be desorbed from the coating layer 6 during working. To the contrary, when the amount of the anti-slipping particle 7 added is less than the lower limit value, the amount of the anti-slipping particle 7 dispersed in the coating layer 6 becomes so small that a sufficient anti-slipping effect may not be obtained.

A plurality of fine voids 8 are present in the coating layer 6. Here, a part of the plurality of voids 8 is embedded in the coating layer 6, i.e., being a site having a gas (air, etc.) in a closed space portion, whereas other part is a recessed part that is open on the surface of the coating layer 6.

The voids 8 are nearly spherical, and can be formed by foaming the coating layer-forming material such that the coating layer 6 involves fine bubbles beforehand when the coating layer 6 is formed. In addition, the area percentage of the voids 8 per unit area in an arbitrary cross section of the coating layer 6 is preferably no less than 10% and no greater than 90%, and more preferably no less than 20% and no greater than 80%. When the area percentage exceeds 90%, the strength of the coating layer 6 may be decreased. To the contrary, when the area percentage is less than 10%, sufficient flexibility may not be obtained. The area of the void 8 in an arbitrary cross section can be measured by, for example, "Digital Microscope VHX-900" manufactured by KEYENCE CORPORATION.

In addition, the mean diameter of the void 8 is preferably no less than 10 μm and no greater than 400 μm, and more preferably no less than 30 μm and no greater than 200 μm. When the mean diameter of the void 8 exceeds the upper limit value, the volume of each of the voids 8 becomes so great that the strength of the coating layer 6 may be deteriorated. To the contrary, when the mean diameter of the void 8 is less than the lower limit value, the volume of each of the voids 8 becomes so small that sufficient flexibility may not be obtained. The "mean diameter" as referred to is a mean value of the longest diameter and the shortest diameter of the void 8.

In addition, the number of the voids 8 is preferably no less than 10 and no greater than 10,000 on average in 1 $cm^2$ of a cross sectional area of the coating layer 6. When the number of the voids 8 exceeds the upper limit value, strength of the coating layer 6 may be decreased. To the contrary, when the number of the voids 8 is less than the lower limit value, sufficient flexibility may not be obtained.

The percentage of the volume of the voids 8 with respect to the coating layer 6 is preferably no less than 1% and no greater than 70%. When the percentage of the volume of the voids 8 exceeds the upper limit value, strength of the coating layer 6 may be decreased and the coating layer 6 may be likely to be broken. To the contrary, when the percentage of the volume of the voids 8 is less than the lower limit value, sufficient flexibility may not be obtained.

In the glove 1 having the configuration described above, the base material 5 that constitutes the convexities 3 contains the filler 4. Therefore, the abrasion resistance of the convexities 3 is improved, whereby a superior grip force and anti-slipping effect can be maintained even in use for a long period of time. In addition, since the base material 5 that constitutes the convexities 3 containing the filler 4, tackiness (adhesiveness) is decreased as compared with the case in which the base material 5 does not contain the filler 4, whereby the convexities 3 can be prevented from elimination. Furthermore, in the glove 1, the plurality of convexities 3 are fixed apart from each other in a scattering manner, superior flexibility as a glove is provided. In addition, since each of the convexities 3 are formed to have a substantially flat top surface, the surface area to be in contact with an object to be gripped increases and the glove 1 has a superior grip force.

In addition, the glove 1 has a convexity-free region in which the convexities 3 are not formed at sites corresponding to proximal interphalangeal joints on the palm side of finger portions that cover an index finger, a middle finger and a ring finger among five finger portions. Accordingly, flexibility of joint portions is improved, whereby fingers can be easily flexed. As a result, a wearer is not required to exert excessive power in order to flex his/her fingers, and hand fatigue can be avoided, whereby the working efficiency is improved.

In addition, according to the glove 1, the glove body 2 and the plurality of convexities 3 are integrally coated by the coating layer 6; therefore, abrasion and detachment of the convexities 3 can be effectively prevented. As a result, impairment of abrasion resistance of the glove 1 can be prevented. In addition, since the glove 1 contains the anti-slipping particle 7 in the coating layer 6, superior anti-slipping effect and gripping properties can be achieved. Furthermore, the glove 1 is superior in flexibility since the plurality of fine voids 8 are present in the coating layer 6.

<Production Method of Glove 1>

Next, a method for producing the glove 1 that has the configuration described above will be briefly explained, but the method for producing a glove of the present invention is not limited thereto.

The method for producing the glove 1 includes: a convexity-forming material preparation step for preparing a convexity-forming material including a base material made of a rubber or a resin, and a filler 4; an attaching step for attaching the convexity-forming material on an external surface of a glove body 2 by placing a plate having a plurality of through holes on the external surface of the palm side area of the glove body 2, followed by filling the through holes of the plate with the convexity-forming material to permit attaching; a plate release step for releasing the plate after the attaching step; a convexity hardening step of heating the convexity-forming material to harden the convexities after releasing the plate; and a coating layer formation step of coating the external surface of the convexities 3 and the glove body 2 with the coating layer 6.

In the convexity-forming material preparation step, the filler 4, a solvent and other additive are appropriately added to a base material that includes a rubber or a resin that serves as a principal component, and the mixture is stirred to prepare the convexity-forming material.

The solvent is exemplified by water, an organic solvent, and the like. The organic solvent is specifically exemplified by aromatic hydrocarbons, isoparaffin-based hydrocarbons, naphthene-based hydrocarbons, dimethylformamide, dimethylacetamide, dimethylsulfoxide, N-methylpyrrolidone, isopropyl alcohol, and the like. Of these, as a solvent in the case in which the principal component of the base material 5 is resin, an aromatic hydrocarbon is preferred. These may be used alone, or in combination of two or more types thereof. The other additive is exemplified by the plasticizer, the stabilizer, the thickening agent, and the like described above.

The upper limit value of the viscosity of the convexity-forming material is preferably 700 Pa·s, more preferably 600 Pa·s and further preferably 550 Pa·s as a $V_2$ value measured by a BH-type viscometer (manufactured by Tokimec, Inc. (manufactured by currently TOKYO KEIKI INC.)). On the other hand, the lower limit value of the viscosity of the convexity-forming material is preferably 200 Pa·s, more preferably 300 Pa*s and further preferably 350 Pa·s as a $V_2$ value measured by a BH-type viscometer. When the viscosity of the convexity-forming material exceeds the upper limit value, filling of holes of a plate with the convexity-forming material becomes difficult in the attaching step described later, whereby formation of the convexities 3 may be difficult. To the contrary, when the viscosity of the convexity-forming material is less than the lower limit value, due to sedimentation of the filler 4 by its own weight, the filler 4 cannot be evenly dispersed in the entire of the convexities 3 and the convexities 3 may not achieve sufficient abrasion resistance, and further the convexities 3 may be broken by its own weight before hardening, after the plate is released in the plate release step described later.

In the attaching step, a plate having a plurality of through holes is placed on the palm surface (i.e., external surface of the palm side area) of the glove body 2 and the convexity-forming material is attached on the surface of the glove body 2 by screen printing, etc. Specifically, the attaching step includes: placing the glove body 2 such that the palm surface faces upward; placing thereon a masking plate having a plurality of through holes; and filling the through holes of the plate with the convexity-forming material using a brush and/or a squeegee, etc. from above. The attaching step enables the convexity-forming material to be attached to the surface of the glove body 2 in a scattered manner.

In the plate release step, the masking plate is released after the attaching step. Due to the convexity-forming material having the filler 4, the convexity-forming material is superior in releasability in the plate release step. Therefore, the convexity-forming material is less likely to follow the plate, whereby the convexities 3 are less likely to be accompanied by deformation, and thus the convexities 3 having a desired shape can be formed.

In the convexity hardening step, the convexities 3 are hardened by heating the convexity-forming material after the plate release step. Since the convexity-forming material contains the filler 4, shape retention of the convexities 3 becomes superior and the shape of the convexities 3 is less likely to be changed until the convexities 3 are hardened. Therefore, the convexities 3 having a desired shape can be evenly formed.

The coating layer formation step includes: adding the anti-slipping particle 7, a solvent and other additive to a rubber or a resin that serves as a principal component of the coating layer 6; stirring the mixture; subjecting the mixture to mechanical foaming by a mixer, etc. to prepare the coating layer-forming material; immersing the glove after the convexity hardening step in the coating layer-forming material, and picking up the glove; carrying out a heat treatment to form the coating layer 6 on the external surface of the glove. The upper limit value of the viscosity of the coating layer-forming material is preferably 6,000 mPa·s and more preferably 5,000 mPa·s as a $V_6$ value measured by a BM-type viscometer (manufactured by Tokimec, Inc. (manufactured by currently TOKYO KEIKI INC.)). On the other hand, the lower limit value of the viscosity of the coating layer-forming material is preferably 1,000 mPa·s, and more preferably 1,500 mPa·s similarly as a $V_6$ value. When the viscosity of the coating layer-forming material exceeds the upper limit value, the viscosity may be so high that formation of the coating layer 6 may be difficult, and the thickness of the coating layer 6 increases and thus the flexibility of the glove may be deteriorated. To the contrary, when the viscosity of the coating layer-forming material is less than the lower limit value, the strength of the coating layer 6 may be decreased. In addition, the upper limit value of the foaming ratio of the coating layer-forming material is preferably 350%, and more preferably 300% as a percentage by volume. On the other hand, the lower limit value of the foaming ratio is preferably 1% and more preferably 50% as a percentage by volume. When the foaming ratio exceeds the upper limit value, the strength of the coating layer 6 may be deteriorated. To the contrary, when the foaming ratio is less than the lower limit value, sufficient flexibility may not be obtained. The volume of gas contained in the coating layer-forming material can be determined by the following formula. In the following formula, (A) represents a volume of 100 g of the coating layer-forming material before foaming, and (B) represents a volume of 100 g of the coating layer-forming material after foaming.

$$[(B)/(A)]\times 100(\%)$$

SECOND EMBODIMENT

Figure 3:
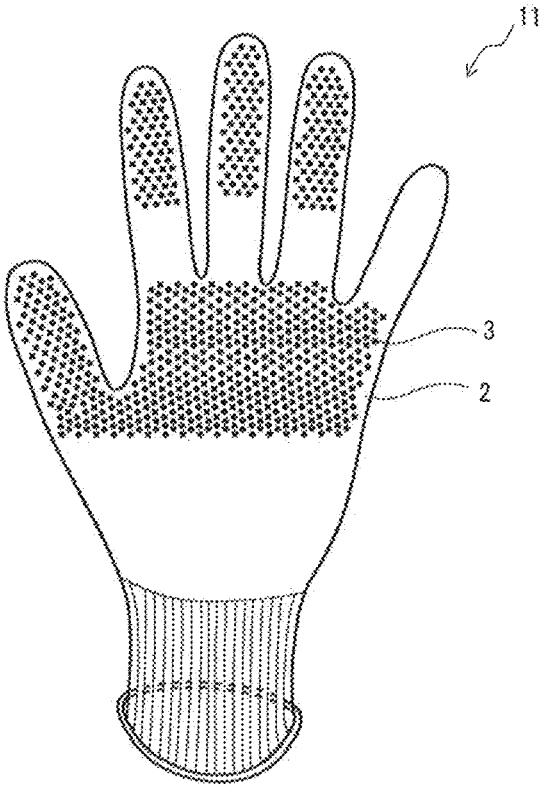
FIG. 3 shows a schematic front view illustrating a glove according to a second embodiment of the present invention viewed from the palm side.
Figure 4:
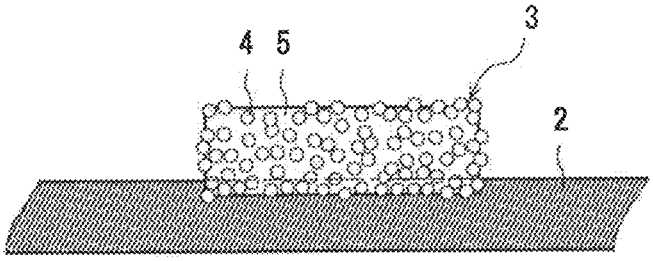
FIG. 4 shows a schematic partial cross sectional view illustrating convexities of the glove shown in FIG. 3.

A glove 11, as shown in FIG. 3, includes a glove body 2 made from fibers and a plurality of convexities 3 fixed to at least the palm side area of the external surface of the glove body 2. Since the glove body 2 and the convexities 3 are similar to the glove body 2 and the convexities 3 of the glove 1 described above, the same reference symbols are used and description is omitted.

In addition, a proximal portion of the glove body 2 has stretchability in a circumferential direction, whereby the proximal portion of the glove body 2 is expandably and contractibly provided in a radial direction. In addition, a portion closer to fingertips than the proximal portion of the glove body 2 also has stretchability in a circumferential direction and is expandably and contractibly provided in a diameter direction. Here, the proximal portion has higher stretchability than other portions (portions closer to fingertips side portion), and is provided such that the degree of contraction becomes smaller than that on a wrist of an assumed wearer. Accordingly, more superior fit can be obtained upon wearing.

The glove 11 that has the configuration described above is superior in an anti-slipping effect since the base material 5 of the convexities 3 is made of a rubber or a resin. In addition, due to the base material 5 of the convexities 3 that contains a filler 4, tackiness (adhesiveness) is decreased and the convexities 3 are prevented from detachment as compared with the case in which the base material 5 does not contain the filler 4, and further abrasion resistance of the convexities 3 is improved, whereby a grip force is less likely to be decreased even in use for a long period of time. In addition, since a coating layer 6 is not laminated on the glove 11, the glove 11 is superior in breathability, and further has more superior flexibility than the glove 1 according to the first embodiment. Furthermore, the glove 11 is superior in fit due to the proximal portion of the glove body 2 having stretchability in a circumferential direction, whereby the glove 11 can be suitably used as a glove for working, generally referred to.

<Production Method of Glove 11>

A method for producing the glove 11 includes: a convexity-forming material preparation step for preparing a convexity-forming material including a base material made of a rubber or a resin, and a filler 4; an attaching step for attaching the convexity-forming material on an external surface of a glove body 2 by placing a plate having a plurality of through holes on an external surface of the palm side area of the glove body 2, followed by filling the through holes of the plate with the convexity-forming material to permit attaching; a plate release step for releasing the plate after the attaching step; and a convexity hardening step of heating the convexity-forming material to harden the convexities after releasing the plate. The convexity-forming material preparation step, the attaching step, the plate release step and the convexity hardening step are identical to the convexity-forming material preparation step, the attaching step, the plate release step and the convexity hardening step, respectively, in the method for producing the glove 1 described above, so that description of the same is omitted.

OTHER EMBODIMENTS

The present invention can be put into practice in aspects with various modification and improvement as well as the aspects described above. In the each embodiment described above, a coupling agent may be added to the base material 5 in order to improve the adhesive force between the filler 4 and the base material 5. Examples of the coupling agent include a silane coupling agent, a titanate-based coupling agent, an aluminate-based coupling agent, and the like. Of these, the silane coupling agent superior in versatility is preferred. The amount of the coupling agent added is preferably no less than 1 part by mass and no greater than 10 parts by mass with respect to 100 parts by mass of the base material. When the amount of the coupling agent added is less than 1 part by mass, sufficient adhesiveness may not be obtained. To the contrary, when the amount of the coupling agent added exceeds 10 parts by mass, an effect by adding the coupling agent in such an amount can not be achieved, and may rather lead to the deterioration of strength, etc. of the base material 5. In addition, also in order to improve the adhesiveness of the coating layer 6 to the anti-slipping particle 7, the coupling agent described above can be similarly used.

In addition, although the coating layer-forming material is subjected to mechanical foaming using a mixer, etc. in the method for producing the glove 1 according to the first embodiment, the voids 8 may be formed in the coating layer 6 by adding a chemical foaming agent to the coating layer-forming material, and utilizing, e.g., thermal expansion. Examples of such a chemical foaming agent include toluenesulfonyl hydrazide, PP'oxybis(benzosulfonyl hydrazide), azodicarbonamide, azobisisobutyronitrile, and the like. Furthermore, the foaming with the chemical foaming agent and the foaming by a machine may be carried out in combination. When the chemical foaming and the mechanical foaming are thus combined, the number of the voids 8 contained in the coating layer 6 increases, and bubble scars can be formed on the surface of the coating layer 6. Specifically, the bubble scars present a fine uneven shape, and due to such a fine uneven shape formed on the surface of the coating layer 6, water and/or oil is/are absorbed into the bubble scars to permit elimination even when water and/or oil is/are interposed between the surface of the glove and an object to be gripped. Therefore, an anti-slipping effect of the glove can be improved.

Furthermore, although the convexities 3 are arranged on the palm side of the glove body 2 in each of the embodiments, convexities 3 may be arranged at the back of the hand as well as the palm side, alternatively, the convexities 3 may be formed on only a finger portion(s) of the palm side area.

Moreover, although the glove body 2 having a thumb portion, an index finger portion, a middle finger portion, a ring finger portion and a little finger portion that cover a thumb, an index finger, a middle finger, a ring finger and a little finger, respectively, of a wearer is adopted in each of the embodiments, a so-called mitten-type glove in which an index finger portion, a middle finger portion, a ring finger portion and a little finger portion are integrated to collectively cover the index finger, a middle finger, a ring finger and a little finger may be adopted. Furthermore, the shape of the convexities 3 is not limited to a columnar shape, and may be a square pole shape, a polyhedron shape, an elliptical shape, or the like. Also, the coating layer 6 may have breathability. In addition, although the convexities 3 are not arranged on the palm side area of the little finger portion in each of the embodiments described above, the convexities 3 may be arranged on the palm side area of the little finger portion. Further, as a filler that constitutes the convexities 3, those having different particle sizes may be used in combination in order to improve a filling rate.

EXAMPLES

Hereinafter, the present invention will be explained in further detail by way of Examples and Comparative Examples, but the invention is not limited to the following Examples.

Example 1

A glove body was knitted using two pieces of a cotton thread of 30th-string and one piece of a cotton thread of 40th-string, and using a 13-gauge flat knitting machine (model N—SFG, manufactured by SHIMA SEIKI MFG., LTD.). The glove body was subjected to a refining treatment (oil removing) in a hot water bath at 90° C. for 10 min and was dried by an oven at 120° C. for 40 min, and subsequently the glove body was placed on a flat-type glove mold (i.e., mold plate) made of aluminum. Then, convexities were formed on the entire surface of a palm side area including five finger portions of the glove body by screen printing using each of the convexity-forming materials shown in Table 1 below. The glove body on which the convexities were formed was subjected to a heat treatment in a furnace at 190° C. for 10 min to harden the convexities, followed by cooling to a room temperature, and subsequently release from the glove mold gave the glove of Example 1. The viscosity ($V_2$) of the convexity-forming material used was 400 Pa·s, and a screen plate used for application of the convexity-forming material was a stainless plate having a thickness of 0.5 mm in which through holes having a diameter of 3 mm were provided in a regular triangle lattice pattern shape, with the shortest distance between adjacent holes being 2 mm. The shape of the convexities formed on the glove of Example 1 was columnar having a diameter of the top surface of 3 mm and a height (H) of 0.8 mm, and the hardness of the convexities was A80. The hardness of the convexities is represented as a measured value of type A of a durometer hardness determined in accordance with a method of JIS K6253, and the "regular triangle lattice pattern" as referred to means a pattern formed by arranging the convexity on each vertex of regular triangles obtained by dividing a surface into regular triangles having the same shape.

TABLE 1

| Raw material | Trade name | Manufacturer | Additive amount (parts by mass) |
|---|---|---|---|
| polyvinyl chloride resin | ZEST (registered trademark) P21 | Shin Dai-Ichi Vinyl Corporation | 100 |
| polyvinyl chloride-based particle (mean particle size: 120 μm) | ZEST (registered trademark) 2500Z | Shin Dai-Ichi Vinyl Corporation | 100 |
| ester-based plasticizer | Mesamoll (registered trademark) | LANXESS Co, | 130 |
| Mg—Zn-based stabilizer | SC-72 | ADEKA CORPORATION | 6 |
| thickening agent | REOLOSIL (registered trademark) QS-102 | TOKUYAMA Corporation | Proper quantity |

Example 2

A glove of Example 2 was obtained in a similar manner to the Example 1 except that the convexities were arranged except for sites corresponding to the proximal interphalangeal joints of four finger portions other than a thumb portion among five finger portions.

Example 3

A glove of Example 3 was obtained in a similar manner to the Example 1 except that the polyvinyl chloride-based particle used as a filler was replaced with calcium carbonate.

Example 4

A glove of Example 4 was obtained in a similar manner to the Example 1 except that the amount of the ester-based plasticizer "Mesamoll (registered trademark)" added was changed to 150 parts by mass. The hardness of the convexities formed on the glove was A70.

Example 5

A glove of Example 5 was obtained in a similar manner to the Example 1 except that the amount of the ester-based plasticizer "Mesamoll (registered trademark)" added was changed to 170 parts by mass. The hardness of the convexities formed on the glove was A63.

Example 6

A glove of Example 6 was obtained in a similar manner to the Example 1 except that the amount of the ester-based plasticizer "Mesamoll (registered trademark)" added was changed to 210 parts by mass. The hardness of the convexities formed on the glove was A47.

Example 7

A glove of Example 7 was obtained in a similar manner to the Example 1 except that the amount of the polyvinyl chloride-based particle added was changed to 200 parts by mass.

Example 8

A glove of Example 8 was obtained in a similar manner to the Example 1 except that the amount of the polyvinyl chloride-based particle added was changed to 300 parts by mass.

Example 9

A glove of Example 9 was obtained in a similar manner to the Example 1 except that the amount of the polyvinyl chloride-based particle added was changed to 500 parts by mass.

Example 10

A glove of Example 10 was obtained in a similar manner to the Example 1 except that the particle size of the polyvinyl chloride-based particle was no less than 180 μm and no greater than 212 μm. The particle size was represented as a numerical value determined through classification using a sieve.

Example 11

A glove of Example 11 was obtained in a similar manner to the Example 1 except that the particle size of the polyvinyl chloride-based particle was no less than 212 μm and no greater than 250 μm. A measuring method of the particle size was similar to that in the Example 9.

Example 12

A glove of Example 12 was obtained in a similar manner to the Example 1 except that the particle size of the polyvinyl chloride-based particle was no less than 250 μm and no greater than 300 μm. A measuring method of the particle size was similar to that in the Example 9.

Comparative Example 1

A glove of Comparative Example 1 was produced in a similar manner to the Example 1 except that the polyvinyl chloride-based particle "ZEST (registered trademark) 2500Z (manufactured by Shin Dai-Ichi Vinyl Corporation)" was not added.

Example 13

The glove obtained in the Example 1 was placed on a glove mold made of aluminum, and the glove mold and the glove were immersed in the coating layer-forming material shown in Table 2 below and picked up. A heat treatment was carried out in a furnace at 200° C. for 10 min to harden the coating layer, followed by cooling to room temperature. Thereafter, the glove was released from the glove mold to give a glove of Example 13. The viscosity $V_6$ of the coating layer-forming material used was 4,500 mPa·s.

TABLE 2

| Raw material | Trade name | Manufacturer | Additive amount (parts by mass) |
|---|---|---|---|
| polyvinyl chloride resin | ZEST (registered trademark) P21 | Shin Dai-Ichi Vinyl Corporation | 100 |
| phthalic acid ester-based plasticizer | DINP | J-PLUS Co., Ltd. | 80 |
| polyester-based plasticizer | W-2610 | DIC Corporation | 15 |
| epoxydated soybean oil | O-130P | ADEKA CORPORATION | 3 |
| Mg—Zn-based stabilizer | SC-72 | ADEKA CORPORATION | 3 |
| thickening agent | REOLOSIL (registered trademark) QS-102 | TOKUYAMA Corporation | proper quantity |

Example 14

A glove of Example 14 was obtained in a similar manner to the Example 13 except that 50 parts by mass of a polyvinyl chloride-based particle "ZEST (registered trademark) 1300Z (manufactured by Shin Dai-Ichi Vinyl Corporation)" (particle size: 120 to 180 μm) as an anti-slipping particle was further added to the coating layer-forming material shown in the above Table 2.

Example 15

A glove of Example 15 was obtained in a similar manner to the Example 14 except that the coating layer-forming material shown in the above Table 2 was allowed to be foamed with a hand mixer to give the foaming ratio of 200%.

Example 16

A glove of Example 16 was obtained in a similar manner to the Example 13 except that the glove obtained in the Example 2 was used.

Comparative Example 2

A glove of Comparative Example 2 was obtained by forming a coating layer in a similar method to the Example 11 on the glove obtained in the Comparative Example 1.

Comparative Example 3

The knitted glove used in the Example 1 was placed on a glove mold made of aluminum, and the glove mold and the glove were immersed in the coating layer-forming material shown in the above Table 2 and picked up. A heat treatment was carried out in a furnace at 200° C. for 1 min, and further the glove mold and the glove were immersed again in the coating layer-forming material shown in the above Table 2 and picked up. A heat treatment was carried out in a furnace at 200° C. for 10 min, and the glove was released from the glove mold to give a glove of Comparative Example 3.

<Fixing Strength Test>

A fixing strength test of convexities of the glove produced in the Examples and Comparative Examples was carried out. The fixing strength test was carried out in accordance with an Abrasion resistance test according to European Standards EN388 using a test instrument "Nu-Martindale AA-K01 (manufactured by James H. Heal & co. Ltd.)". Specifically, test pieces collected from the center of the palm portion of each glove produced in the Examples and Comparative Examples were visually confirmed every time the test pieces were abraded 100 times, respectively, using Nu-Martindale, and the number of times of the abrading operation was determined until detachment of the convexities was confirmed. Larger number of times of the abrading operation reveals higher fixing strength of the convexities. The abrading operation was carried out using NORTON Oakey 117 Cabinet Quality Glass paper grit 100 GRADE F2 manufactured by Saint-Gobain Abrasives, Inc. as a polishing paper. The results are shown in Table 3 below.

<Flexibility Test>

In addition, sensory evaluations on flexibility of the glove provided with the convexities were carried out. Specifically, 10 subjects wore each glove produced in the Examples and Comparative Examples, and the flexibility was evaluated based on the following evaluation criteria. The results are shown in the Table 3 and Table 4 below.

(Evaluation Criteria of Flexibility)

A: flexibility being present and flexing of fingers being extremely good

B: flexibility being present and flexing of fingers being good

C: flexibility being present and there being no problem for flexing of fingers

D: flexibility being absent and flexing of fingers being difficult

E: flexibility being absent and flexing of fingers being extremely difficult

<Processability Test>

In addition, processability of the convexities was evaluated. Specifically, general evaluations were carried out as to: whether or not it was possible to easily fill through holes with the convexity-forming materials when the convexities were to be formed on the external surface of the glove using a plate which was a stainless plate having a thickness of 0.5 mm in which through holes having a diameter of 3 mm were provided in a scattered manner; and whether or not the shape of the convexities was evenly formed after plate releasing and hardening. The results are shown in Table 3 and Table 4 below.

(Evaluation Criteria of Processability)

A: processability being extremely good

B: processability being good

C: processability being somewhat poor but processable

D: processability being poor

E: processability being extremely poor

TABLE 3

| | The number of times of abrading operation | Flexibility | Processability | Remarks (details of processability) |
|---|---|---|---|---|
| Example 1 | 10,000 | B | A | |
| Example 2 | 9,800 | A | A | |
| Example 3 | 10,000 | B | A | |
| Example 4 | 8,700 | B | A | |
| Example 5 | 7,200 | B | B | |
| Example 6 | 6,500 | B | B | |
| Example 7 | 9,800 | B | A | |
| Example 8 | 9,600 | B | B | |
| Example 9 | 9,500 | B | C | filling of the through holes with the convexity-forming material being difficult |
| Example 10 | 9,800 | B | A | |
| Example 11 | 10,500 | B | B | |
| Example 12 | 9,600 | B | C | formation of flat top surfaces of convexities being difficult |
| Comparative Example 1 | 5,600 | B | E | formation of flat top surfaces of convexities being extremely difficult, and plate release after attaching of the convexity-forming material being extremely difficult |

The results shown in Table 3 reveal that according to the glove of the Examples 1 to 12 in which convexities contained a filler, the number of times of abrading operation was greater than that of the glove of the Comparative Example 1 in which convexities contained a filler, indicating improvement of the abrasion resistance. In addition, according to the glove of the Example 2 in which convexities were provided except for sites corresponding to proximal interphalangeal joints of four finger portions other than a thumb portion of five finger portions, flexibility was more improved than the glove of the Example 1 and Examples 3 to 12 in which convexities were provided also at sites corresponding to proximal interphalangeal joints. In addition, according to the glove of the Comparative Example 1 in which convexities did not contain a filler, formation of the convexities was very difficult and processability was extremely poor, which reveals that the processability is improved due to including a filler in the convexities like the gloves of the Examples 1 to 12. However, the processability was somewhat deteriorated, for example, filling of the holes of a plate with the convexity-forming material became difficult (Example 9), formation of flat top surfaces of the convexities became difficult (Example 12), depending on the amount of the filler added and/or the particle size of the filler.

TABLE 4

| | The number of times of abrading operation | Flexibility | Processability | Remarks (details of processability) |
|---|---|---|---|---|
| Example 13 | 13,000 | B | B | |
| Example 14 | 13,800 | B | B | |
| Example 15 | 11,400 | A | B | |
| Example 16 | 13,000 | A | B | |
| Comparative Example 2 | 10,600 | B | E | formation of flat top surfaces of convexities being extremely difficult, and plate release after attaching of the convexity-forming material being extremely difficult |
| Comparative Example 3 | 7,500 | E | — | |

The results shown in the Table 4 reveal that according to the glove of the Examples 13 to 16 in which a coating layer that coats the surfaces of convexities and the glove body was further laminated, the number of times of abrading operation was greater than that of the glove of the Example 1 indicating improvement of the abrasion resistance. In addition, the results shown in the Table 4 reveal that flexibility of the gloves of the Example 15 and Example 16 was further improved than that of the gloves of the Example 13 and Example 14, in which the glove of the Example 15 included the coating layer-forming material subjected to foaming, and the glove of the Example 16 was produced using the glove of the Example 2 provided with convexities arranged except for sites corresponding to the proximal interphalangeal joints of four finger portions other than a thumb portion among five finger portions. Furthermore, according to the Comparative Example 2 in which the glove of the Comparative Example 1 was used, processability was extremely poor similarly to the Comparative Example 1, whereas according to the Comparative Example 3 in which two coating layers were laminated, flexibility was deteriorated.

INDUSTRIAL APPLICABILITY

As described above, the glove of the present invention being superior in abrasion resistance and flexibility and having a grip force less likely to be decreased even in use for a long period of time can be used for various purposes, such as, for example, wearing by workers in plants, wearing by workers in transportation working, wearing by drivers in driving, and the like.

1. glove
2. glove body
3. convexity
4. filler
5. base material
6. coating layer
7. anti-slipping particle
8. void
9. glove

What is claimed is:

1. A glove comprising:

a glove body made from fibers; and a plurality of convexities fixed at least on the palm side area of the external surface of the glove body, the convexities comprising a base material made of a rubber or a resin, and a filler contained in the base material; and wherein the filler has a surface made from an organic substance, the plurality of convexities are arranged in a scattered manner, bases of the convexities are impregnated in a layer at said external surface of the glove body, the glove body comprises: a main body portion formed for covering a main body of a hand; and an extended portion extended from the main body portion formed for covering fingers, wherein the extended portion comprises an index finger portion, a middle finger portion and a ring finger portion that cover an index finger, a middle finger and a ring finger, respectively, and wherein a convexity-free region in which the convexities are not formed is provided at sites corresponding to proximal interphalangeal joints on each surface of the palm sides of the index finger portion, the middle finger portion and the ring finger portion on the palm side surface.

2. The glove according to claim 1, wherein the convexities comprise a substantially flat top surface.

3. The glove according to claim 1, wherein a principal component of the base material is a polyvinyl chloride-based resin.

4. The glove according to claim 1, wherein the mean particle size of the filler is no greater than 300 μm.

5. The glove according to claim 1, wherein the content of the filler is no less than 4 parts by mass and no greater than 400 parts by mass with respect to 100 parts by mass of the base material.

6. The glove according to claim 1, wherein the glove further comprises a coating layer that coats an external surface of the convexities and the glove body in a region provided with the plurality of convexities.

7. The glove according to claim 6, wherein the coating layer comprises an anti-slipping particle.

8. The glove according to claim 6, wherein the coating layer comprises a plurality of fine voids.

9. A method for producing a glove, the method comprising:

preparing a convexity-forming material including a base material made of a rubber or a resin, and a filler having a filler surface made from an organic substance;

attaching the convexity-forming material on an external surface of a glove body by placing a plate having a plurality of through holes on the external surface of the palm side area of the glove body, followed by filling the through holes of the plate with the convexity-forming material to permit attaching;

releasing the plate after attaching; and heating the convexity-forming material to harden the convexities after releasing the plate, wherein the plurality of convexities are arranged in a scattered manner, bases of the convexities are impregnated in a layer at said external surface of the glove body, the glove body comprises: a main body portion formed for covering a main body of a hand; and an extended portion extended from the main body portion formed for covering fingers, wherein the extended portion comprises an index finger portion, a middle finger portion and a ring finger portion that cover an index finger, a middle finger and a ring finger, respectively, and wherein a convexity-free region in which the convexities are not formed is provided at sites corresponding to proximal interphalangeal joints on each surface of the palm sides of the index finger portion, the middle finger portion and the ring finger portion on the palm side surface.

10. The glove according to claim 7, wherein the coating layer comprises a plurality of fine voids.

11. The glove according to claim 1, wherein the filler comprises the organic substance at portions of the filler in addition to the filler surface.

* * * * *